US007490587B2

(12) United States Patent
Rosskamp et al.

(10) Patent No.: US 7,490,587 B2
(45) Date of Patent: Feb. 17, 2009

(54) PORTABLE HANDHELD WORK APPARATUS

(75) Inventors: Heiko Rosskamp, Adelberg (DE); Georg Maier, Kernen (DE); Volker Reber, Michelbach (DE); Alexander Erkert, Korb (DE); Daniel Herbst, Karlsruhe (DE); Marcus Saak, Gerolsheim (DE); Dirk Schweinberger, Karlsruhe (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/976,637

(22) Filed: Oct. 26, 2007

(65) Prior Publication Data

US 2008/0121208 A1 May 29, 2008

(30) Foreign Application Priority Data

Oct. 26, 2006 (DE) ..... 10 2006 050 430

(51) Int. Cl.
*F02D 11/02* (2006.01)

(52) U.S. Cl. ..... 123/319; 123/400; 74/501.6

(58) Field of Classification Search ..... 123/319, 123/478, 480, 396, 397, 398, 399, 400; 30/276; 56/11.3; 74/491, 501.6
See application file for complete search history.

(56) References Cited

U.S. PATENT DOCUMENTS

| | | | | |
|---|---|---|---|---|
| 4,178,920 | A * | 12/1979 | Cawood et al. | 600/107 |
| 6,142,035 | A * | 11/2000 | Babatz et al. | 74/501.6 |
| 6,196,082 | B1 * | 3/2001 | Iwata | 74/501.6 |
| 6,581,568 | B2 * | 6/2003 | Kramer | 123/398 |
| 6,640,444 | B1 * | 11/2003 | Harada et al. | 30/277.4 |
| 6,666,187 | B2 | 12/2003 | Dahlberg et al. | |
| 7,000,593 | B2 * | 2/2006 | Muller et al. | 123/398 |
| 7,270,111 | B2 * | 9/2007 | Grybush et al. | 123/400 |
| 2007/0234578 | A1 * | 10/2007 | Menzel et al. | 30/383 |

* cited by examiner

*Primary Examiner*—Willis R. Wolfe, Jr.
*Assistant Examiner*—Johnny H. Hoang
(74) *Attorney, Agent, or Firm*—Walter Ottesen

(57) ABSTRACT

A portable handheld work apparatus has a drive motor as well as an adjusting element for controlling the drive motor. The work apparatus has at least one actuating element. A movement of the actuating element is transmitted to the adjusting element via a transmitting unit. A good operator control is achieved when at least one transmitting characteristic (49, 50; 89, 90; 309, 310) of the transmitting unit runs nonlinearly as a function of the actuating displacement (s) of the actuating element.

25 Claims, 8 Drawing Sheets

PORTABLE HANDHELD WORK APPARATUS

CROSS REFERENCE TO RELATED APPLICATION

This application claims priority of German patent application no. 10 2006 050 430.5 filed Oct. 26, 2006, the entire content of which is incorporated herein by reference.

FIELD OF THE INVENTION

The invention relates to a portable handheld work apparatus having a drive motor and an adjusting element for controlling the drive motor. The work apparatus has at least one actuating element and a movement of the actuating element is transmitted to the adjusting element via a transmitting unit.

BACKGROUND OF THE INVENTION

U.S. Pat. No. 6,666,187 discloses a motor-driven work apparatus having an actuating element which is pivotally supported. The actuating element lies against a resiliently biased stop. The pretension of the spring force is adjustable and the actuating force is adjustable in this way.

When actuating a drive motor, especially an internal combustion engine, a fine adjustment is desirable in some ranges of the actuation; whereas, in other ranges of actuation only a coarse adjustment is needed. In known transmitting units, the transmitting characteristic can, however, be adjusted at most for the entire actuating path. In this way, an inadequate operating comfort results.

SUMMARY OF THE INVENTION

It is an object of the invention to provide a portable handheld work apparatus of the kind described above wherein the comfort for the operator is increased.

The portable handheld work apparatus of the invention includes: a drive motor; an adjusting element operatively connected to the drive motor for controlling the drive motor; a movable actuating device displaceable through an actuating displacement (s); a transmitting unit for transmitting a movement of the actuating device to the adjusting element; and, the transmitting unit defining a transmitting characteristic which is a nonlinear function of the actuating displacement (s).

The nonlinear course of the transmitting characteristic makes possible that a precise adjustment of the adjusting path is possible in the ranges of the actuating path wherein a precise adjustment is required; whereas, in ranges where a precise adjustment of the adjusting element is not needed, a simple and quick operator control via a coarse adjustment of the position of the adjusting element is made possible. In this way, a higher level of comfort in operation is achieved.

Advantageously, the transmitting unit has a first transmitting characteristic in a first range and a second transmitting characteristic in a second range of the actuating path. Especially when the drive motor is an internal combustion engine and the adjusting element is a throttle flap, a precise capability of adjustment is necessary at low rpms of the engine; whereas, at high rpms, a coarse positioning of the throttle flap is sufficient. This can be achieved in that the transmitting characteristic at low rpm distinguishes from the transmitting characteristic at high rpms. In both ranges, respective linear courses of the transmitting characteristic can be provided. Advantageously, the transmitting unit has a stop which is actuated after passing through the first operating range of the actuating path. The position of the stop is especially adjustable so that the operator can adjust up to which actuating path the first range should extend, that is, up to which actuating path a fine adjustment is wanted.

To prevent an unintended movement out of the first range, an adjustable latch device is provided which, in a first latched position, blocks a further actuation of the actuating element after passing through the first range of the actuating path and which, in a second released position, permits a further actuation of the actuating element. In order to completely actuate the actuating element, the operator must thereby first shift the latch device in the second actuated position.

Advantageously, a transmitting characteristic, which does not run linearly, is the actuating force. In this way, the operator can make a coarse adjustment in a range with low actuating force. In the second range, a higher actuating force is needed so that a fine adjustment of the actuating element can take place. The user receives feedback via the spring as to which range of actuation the operator is in. In this way, the operation by the user is simplified. The transmitting unit practically includes a spring which opposes the movement of the actuating element in one of the ranges of the actuating path.

It can, however, also be provided that a transmitting characteristic, which does not run linearly, is the positioning path of the actuating element. In one of the ranges, a long actuating path is needed for a pregiven displacement path; whereas, in the other range, a considerably smaller actuating path is needed for the same displacement path. In this way, in the first range, a fine adjustment of the adjusting element takes place while in the second range, a rapid actuation is possible. This is especially advantageous when the actuating element is a throttle flap. Because of the geometry, a displacement of the throttle flap out of the closed position effects a large change of the flow cross section. A displacement by a corresponding angle with an almost completely open throttle flap has only a slight influence on the flow cross section. A nonlinearly running adjusting path thereby permits an adaptation of the actuating path to the change of the flow cross section. In this way, with the displacement of the actuating element by an actuating path, independent of the position of the throttle flap, the same or almost the same change of the free flow cross section results.

Advantageously, the transmitting unit includes a transmitting element. The actuating element acts upon the transmitting element via an intermediate lever. It is provided that the transmitting element is fixed to an attachment point on the intermediate lever. In this way, the nonlinear transmitting characteristic can be adjusted via the intermediate lever.

It is provided that the actuating element is pivotally supported about a first pivot axis on the intermediate lever and that the intermediate lever is pivotally supported on the housing of the work apparatus about a second pivot axis. The second pivot axis has a different distance to the attachment point of the transmitting element measured perpendicularly to the actuating direction of the transmitting element than the first pivot axis. The first pivot axis as well as the second pivot axis has a distance to the attachment point which is greater than zero. The lever arms for the actuation of the transmitting element are of different size in the two ranges. For this reason, different adjusting paths result for the same actuating path. In this way, and in a simple manner, a nonlinear transmitting characteristic is achieved. The nonlinearity of the transmitting unit is constructively pregiven because of the two pivot axes spaced from each other. In the first range of the actuating path, the actuating element pivots about the first pivot axis and, in the second range of the actuating path, the actuating element and the intermediate lever pivot together about the second pivot axis.

It can, however, also be provided that the actuating element is pivotally supported about a first pivot axis on the housing and that the intermediate lever is pivotally supported about a second pivot axis on the actuating element. Advantageously, the intermediate lever moves along a cam contour relative to the housing. The form of the cam contour determines the transmitting characteristic between actuating element and adjusting element. It can also be provided that the actuating element is pivotable about a first axis in the housing and that the intermediate lever is guided to be displaceable in the housing. The intermediate lever is especially actuated by the actuating element via a cam contour. Advantageously, the position of the cam contour is adjustable via an adjusting device. In this way, the position of the first and second ranges and therefore the transmitting characteristic of the transmitting unit can be adjusted.

It can also be provided that the actuating element is pivotally supported about a first pivot axis on the housing and that the intermediate lever is pivotally supported about a second pivot axis on the housing. Advantageously, the actuating element acts on a cam contour of the intermediate lever when pivoting about the first pivot axis and pivots the intermediate lever about the second pivot axis. The transmitting characteristic can be influenced by the arrangement of the pivot axes and the configuration of the cam contour.

It can also be provided that the transmitting element is fixed on the actuating element. It is advantageous when the actuating element is pivotally supported about a first pivot axis and about a second pivot axis. The actuating element pivots about the first pivot axis in the first range of the actuating path and pivots about the second pivot axis in the second range of the actuating path. With the two different pivot axes, there result different transmitting characteristics in the first and second ranges which are determined by the position of the pivot axes. In order to achieve a nonlinear transmitting characteristic, it can also be provided that the transmitting element is held on an attachment pin on the actuating element. The position of the attachment pin on the actuating element changes in dependence upon the actuating path of the actuating element. If the position of the attachment pin on the actuating element changes continuously, for example, by guidance in a slot, a continuous change of the transmitting characteristic can be achieved thereby. The position change takes place especially not perpendicularly to the actuating direction of the transmitting element.

The transmitting unit has a deflecting cam which is at a distance to the transmitting element in a first range of the actuating path and which, in a second range of the actuating element between an attachment point of the transmitting element and the adjusting element, acts on the transmitting element and deflects the transmitting element. The deflecting cam effects an additional actuation of the transmitting element and therewith of the adjusting element. When the deflecting cam is not in engagement, the transmitting element is moved only by the movement of the actuating element. As soon as the deflecting cam comes into engagement with the transmitting element, the actuating element as well as the deflecting cam effect an actuation of the transmitting element. In this way, a nonlinear transmitting characteristic is achieved.

It can also be provided that a first actuating element is provided for the actuation in a first range of the actuating path and a second actuating element is provided for the actuation in a second range of the actuating path. The two actuating elements thereby determine different transmitting characteristics. It is provided that the transmitting element is fixed to an attachment point on the first actuating element and that the second actuating element acts on the transmitting element between the attachment point of the transmitting element and the adjusting element. The two actuating elements thereby operate substantially independently of each other on the transmitting element. Also, the simultaneous actuation of both actuating elements is possible. It can, however, also be provided that the transmitting element is fixed on the first actuating element and that the second actuating element acts on the first actuating element. With a corresponding geometric arrangement of the actuating elements, different transmitting characteristics are achieved when actuating the first and second actuating elements, respectively.

A substantially free configuration of the transmitting characteristic can be achieved when the actuating path of the actuating element is transferred electrically to the adjusting element. Advantageously, the actuating element actuates an electric adjusting device which generates an electrical signal corresponding to the actuating path. It is provided that the electrical signal is the input signal of a control which generates an output signal in dependence upon a wanted transmitting characteristic which output signal determines the position of the adjusting element. The transmitting characteristic stored in the control can be freely selected and can be matched to the work apparatus. For different transmitting characteristics in different work apparatus, only the transmitting characteristic, which is stored in the control, need be adapted. A constructive adaptation of the transmitting unit is not necessary.

Advantageously, the work apparatus has a switch element with which a unit for generating the nonlinear transmitting characteristic can be switched into an inactive state. In this way, the operator can select whether a nonlinear transmitting characteristic is wanted in at least one range. Should the user want a linear transmitting characteristic for specific cases of use, then this can be set by the switch element. Especially, the course of the nonlinear transmitting characteristic can also be influenced or set via the switch element.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
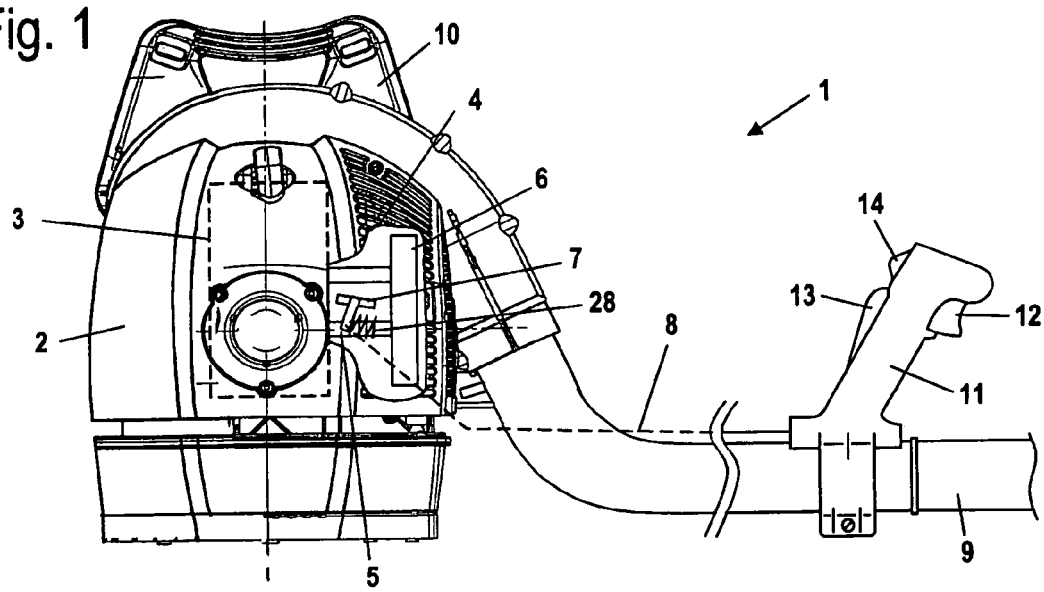
FIG. 1 is a schematic of a work apparatus according to the invention.

FIG. 1 shows a schematic of a blower apparatus 1 which is configured as a backpack blower apparatus. The blower apparatus 1 has a housing 2 which is mounted on a back carrier 10. An internal combustion engine 3 is mounted in the housing 2 and drives a blower wheel (not shown). The blower wheel moves an airflow through a blower tube 9. A handle 11 is fixedly mounted on the blower tube 9 and has a throttle lever 12, a throttle lever lock 13 as well as an off switch 14. The throttle lever 12 actuates a transmitting element 8 which can, for example, be a bowden cable. The transmitting element 8 is connected to a throttle element 7 pivotally journalled in an intake channel 4 of the internal combustion engine 3. When actuating the throttle lever 12, the actuating movement is transmitted via the transmitting element 8 to the throttle element 7. The throttle element 7 is spring biased in the direction toward its completely closed position by a spring 28. The throttle element 7 is mounted in a carburetor 5 which is mounted in flow direction between an air filter 6 and the internal combustion engine 3. The throttle element 7 is especially a throttle flap. The internal combustion engine 3 can, for example, be a two-stroke motor or a four-stroke engine.

For a slightly open position of the throttle flap 7, a slight actuation of the transmitting element 8 already effects a large change of the quantity of air inducted. In contrast, for a substantially open throttle flap, a slight actuation of the transmitting element 8 effects only a very slight change of the inducted airflow. For this reason, it is desirable not to transfer the movement of the throttle lever 12 linearly to the movement of the throttle element 7.

Figure 2:
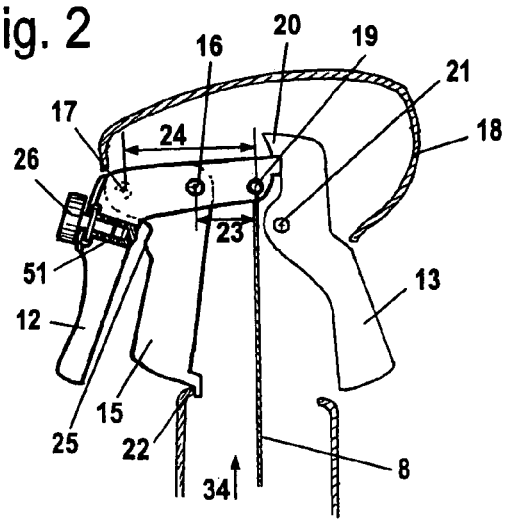
FIGS. 2 to 10 show respective embodiments of transmitting units.

In FIG. 2, an embodiment of a transmitting unit is shown with which the movement of the throttle lever 12 is nonlinearly transmitted to the transmitting element 8. The throttle lever 12 is pivotally supported on a first pivot axis 16 on an intermediate lever 15. The intermediate lever 15 is pivotally supported on a second pivot axis 17 in a housing 18 of the handle 11. The transmitting element 8 is, for example, a bowden cable and is attached to an attachment point 19 on the throttle lever 12. The throttle lever lock 13 is pivotally supported in the housing 18 about a pivot axis 21. A hook 20 is provided on the throttle lever lock 13 and this hook blocks the throttle lever 12 in the unactuated position of the throttle lever lock 13. If the throttle lever lock 13 is actuated, then the hook 20 pivots away from the throttle lever 12 and the throttle lever 12 can be actuated. Because of the spring 28 on the throttle element 7, the throttle lever 12 and the intermediate lever 15 are pulled into the unactuated position shown in FIG. 2 when the throttle lever 12 is not actuated.

To actuate the throttle element 7, the throttle lever lock 13 is first actuated so that the hook 20 pivots away from the throttle lever 12. Thereafter, the throttle lever 12 can be actuated. The throttle lever 12 first pivots about the first pivot axis 16. The first pivot axis 16 is at a first distance 23 to the attachment point 19 measured perpendicularly to the actuating direction 34 of the transmitting element 8. This first distance 23 determines the lever arm with which the transmitting element 8 is actuated. In the unactuated position, the intermediate lever 15 rests against a stop 22 on the housing 18. The intermediate lever 15 has a stop 25.

In the throttle lever 12, a sleeve 51 is mounted which can be adjusted via an adjusting screw 26 in the direction toward the stop 25. The sleeve 51 coacts with the stop 25 as soon as the throttle lever 12 has pivoted by a corresponding angle about the first pivot axis 16. As soon as the sleeve 51 lies against the intermediate lever 15, no further pivoting of the throttle lever 12 relative to the intermediate lever 15 can take place with a further actuation of the throttle lever 12. With a further actuation of the throttle lever 12, the throttle lever 12 and the intermediate lever 15 pivot together about the second pivot axis 17. The second pivot axis 17 is at a second distance 24 to the attachment point 19 and this distance is likewise measured perpendicularly to the actuating direction 34 and defines the lever arm with which the transmitting element 8 is actuated. The second distance 24 is considerably longer than the first distance 23.

As long as the sleeve 51 has not yet come into contact engagement on the stop 25, a pivoting of the throttle lever 12 by a pregiven amount effects an actuation of the transmitting element 8 by a pregiven path displacement. As soon as the sleeve 51 comes to lie against the stop 25 and the throttle lever 12 together with the intermediate lever 15 is pivoted about the second pivot axis 17, a pivoting of the throttle lever 12 through the pregiven angle effects a shift of the transmitting element 8 by a considerably greater adjusting displacement which is dependent upon the ratio of the two distances (23, 24) which can amount to, for example, twice the adjusted displacement which results when there is a pivoting of the throttle lever about the first pivot axis 16.

Figure 3:
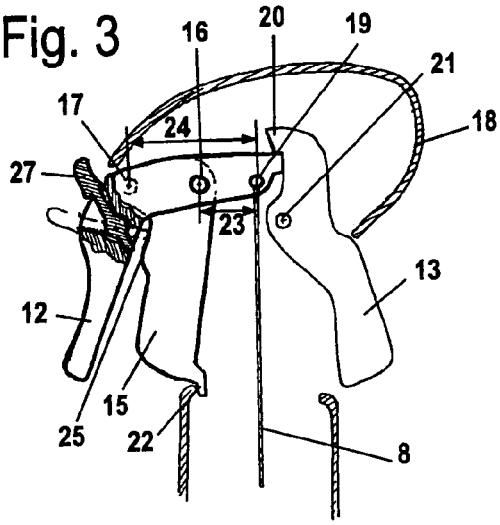

The embodiment of FIG. 3 corresponds essentially to the embodiment of FIG. 2. The same reference numerals identify the same components. In the transmitting unit shown in FIG. 3, a lever 27 coacts with the stop 25 on the intermediate lever 15. The lever 27 is pivotally supported in the throttle lever 12. In this way, an adjustment can be made starting at which actuating displacement of the throttle lever 12, the throttle lever 12 and the intermediate lever 15 pivot together about the second pivot axis 17.

Figure 4:
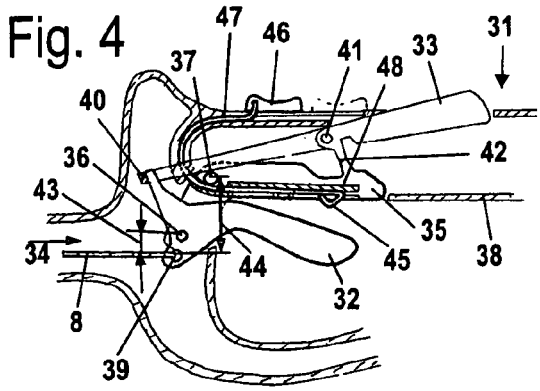

FIG. 4 shows a transmitting unit for another work apparatus having a handle 31. The transmitting unit shown in FIG. 4 can, for example, be provided for a hedge clipper. The handle 31 has a housing 38 wherein an intermediate lever 35 is pivotally journalled about a pivot axis 37. A throttle lever 32 is pivotally supported about a pivot axis 36 on the intermediate lever 35. The pivot axis 36 of the throttle lever 32 is at a distance 43 to an attachment point 39 of the transmitting element 8 with this distance being measured perpendicularly to the actuating direction 34 and being less than a distance 44 of the pivot axis 37 to the attachment point 39 of the transmitting element 8.

The intermediate lever 35 is provided with a stop 45 which is configured on a band 47. The band 47 can, for example, be a metal band. The band 47 is fixed to a slider 46 guided on the housing 38. By actuating the slider 46, the position of the stop 45 on the intermediate lever 35 can be shifted. The band 47 is guided on the intermediate lever 35 with a guide 48 so as to be longitudinally displaceable.

In the housing 38, a throttle lever lock 33 is pivotally supported about a pivot axis 41. The throttle lever lock 33 has a stop 42 against which the intermediate lever 35 rests. Furthermore, the throttle lever lock 33 has a hook 40 which blocks the throttle lever 32 in the unactuated position of the throttle lever lock 33. To actuate the transmitting element 8, the throttle lever lock 33 must first be pivoted about the pivot axis 41. The hook 40 is pivoted away from the throttle lever 32 and the stop 42 from the intermediate lever 35. When actuating the throttle lever 32, the throttle lever 32 first pivots about the pivot axis 36 until the throttle lever 32 comes in contact with the stop 45. Thereafter, the throttle lever 32 and the intermediate lever 35 pivot together about the pivot axis 37. When pivoting about the pivot axis 36, a lever arm is active which corresponds to the distance 43. When pivoting about the pivot axis 37, a lever arm results which corresponds to the longer distance 44 so that, in the range wherein the throttle lever 42 and the intermediate lever 35 pivot together about the pivot axis 37, the transmitting element 8 is actuated with greater intensity. In this way, a nonlinear course results of the transmitting characteristic of the actuating displacement of the throttle lever 32 to the adjusting displacement of the throttle element 7.

Figure 5:
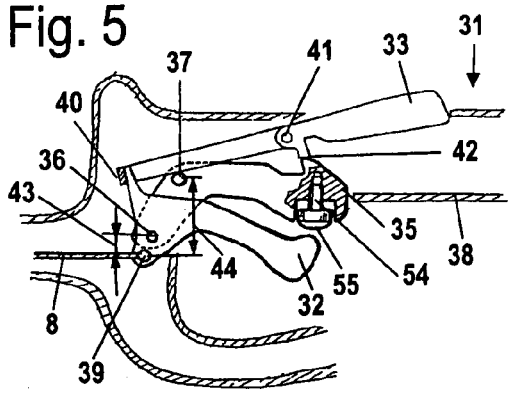

The transmitting unit shown in FIG. 5 corresponds essentially to the transmitting unit of FIG. 4. The same reference numerals identify the same components. The intermediate lever 35 of the transmitting unit shown in FIG. 5 has a stop 55 which is configured on a set screw 54. By screwing in or screwing out the set screw 54, the position of the stop 55 can be changed and, in this way, the transmitting characteristic of the transmitting unit is influenced.

Figure 6:
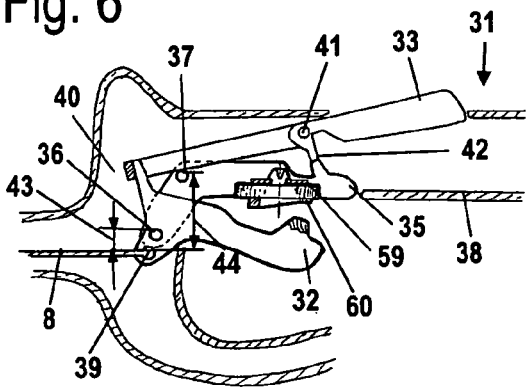

In the embodiment shown in FIG. 6, a stop 60 is provided on the intermediate lever 35 which stop is configured as a cam contour on an adjusting wheel 59. By rotating the adjusting wheel 59, the stop 60 can be adjusted and the transmitting characteristic influenced.

Figure 7:
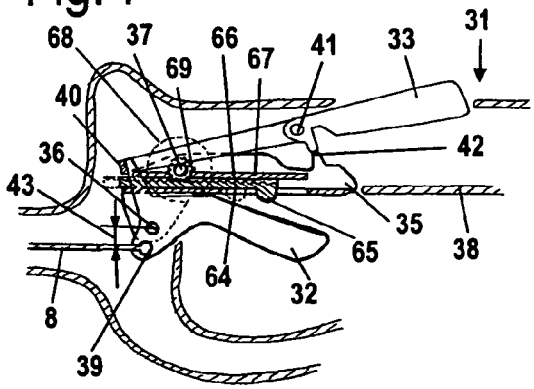

In the embodiment of FIG. 7, a slider 64 is mounted on the intermediate lever 35 and this slider has a stop 65. The slider 64 has teeth 66 which mesh with teeth 69 on the adjusting wheel 68. A rotation of the adjusting wheel 68 effects a longitudinal displacement of the slider 64 and therefore an adjustment of the stop 65. The slider 64 is supported by a guide 67 on the intermediate lever 35.

Figure 8:
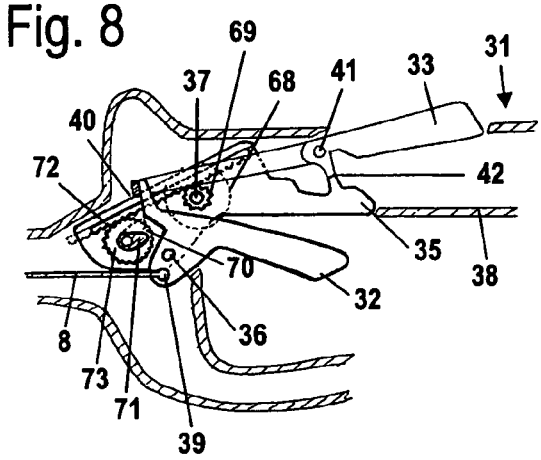

In the embodiment shown in FIG. 8, a stop 70 is provided on a cam 71. The cam 71 is fixed on a toothed wheel 73 which coacts with a toothed rack 72. The toothed rack 72 is held on the intermediate lever 35 and meshes with gear teeth 69 on the adjusting wheel 68. Setting the adjusting wheel 68 effects a longitudinal displacement of the toothed rack 72 and therefore a rotation of the gear wheel 73. In this way, the position of the stop 70 can be shifted on the cam 71.

Figure 9:
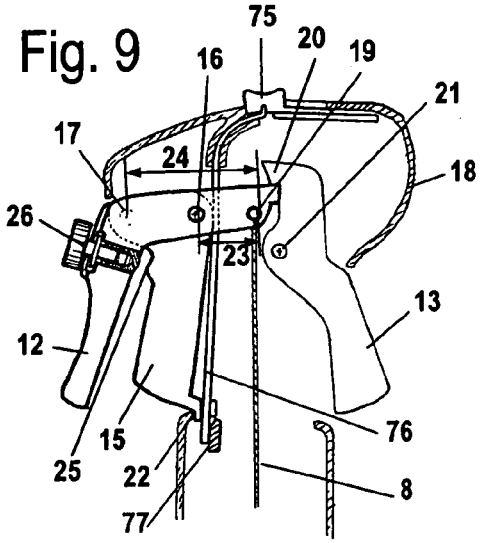

The embodiment shown in FIG. 9 corresponds essentially to the embodiment of FIG. 2. The intermediate lever 15 lies between the stop 22 and a band 76 which is supported on a counter holder 77 on the housing 18. In this way, the intermediate lever 15 cannot be actuated. A lock slider 75 is mounted on the band 76. With an actuation of the lock slider 75, the band 76 is pulled away from the counter holder 77 so that the intermediate lever 15 can be pivoted. The band 76 can, for example, be a metal band.

Figure 10:
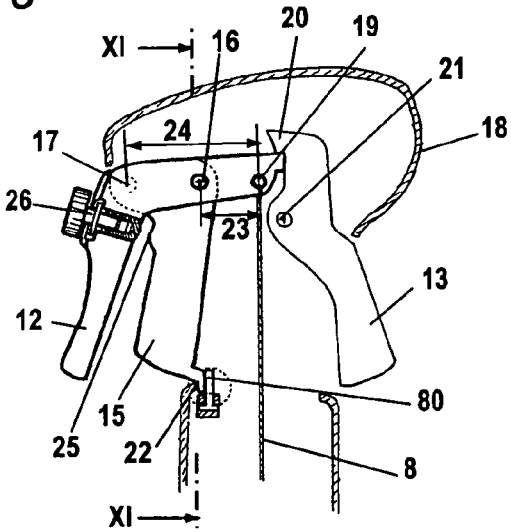
Figure 11:
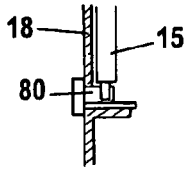
FIG. 11 is a schematic section view taken along line XI-XI in FIG. 10 in a first position of the latch unit.
Figure 12:
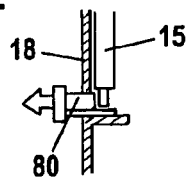
FIG. 12 shows the latch unit of FIG. 11 in a second position.

In the embodiment shown in FIG. 10, a lock slider 80 is provided as a lock device for the intermediate lever 15. The lock slider can be actuated in the direction of the pivot axes 16 and 17. As shown in FIG. 11, the lock slider 80 blocks the intermediate lever 15 in the locked position shown in FIG. 11 so that an actuation of the intermediate lever 15 is not possible. When the lock slider 80 is pushed into the position shown in FIG. 12, then the intermediate lever 15 is released and an actuation of the intermediate lever 15 is possible.

In the embodiments shown in FIGS. 9 and 10, the throttle lever 12 can accordingly be actuated until the throttle lever 12 lies against the stop 25 of the intermediate lever 15. A further actuation is not possible when the lock device is locked. If the lock device is released, then the intermediate lever 15 can also be pivoted. With a further actuation of the throttle lever 12, throttle lever 12 and intermediate lever 15 pivot together about the pivot axis 17.

Figure 13:
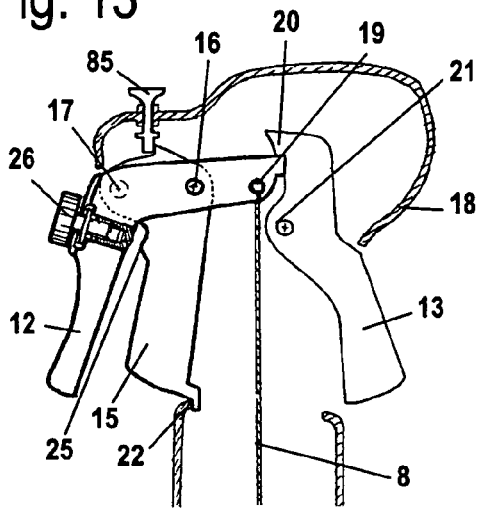
FIG. 13 is a schematic showing another embodiment of a transmitting unit according to the invention.

A further embodiment of a lock device is shown in FIG. 13. Here, a lock slider 85 is provided which blocks a movement of the intermediate lever 15. When the lock slider 85 is pulled outwardly from the housing 18, then the intermediate lever 15 pivots in common with the throttle lever 12 about the pivot axis 17.

Figure 14:
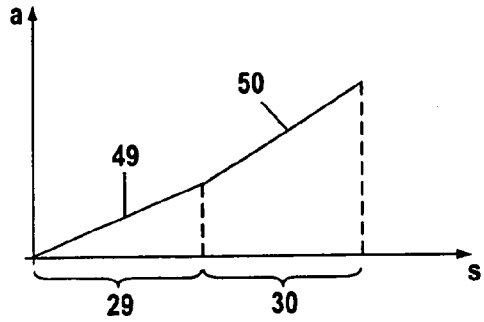
FIG. 14 is a graph of a transmitting characteristic.

In FIG. 14, a course of the adjusting displacement (a) on the throttle element 7 is shown as a function of the actuating displacement (s) of the throttle lever 12. In a first range 29 of the actuating displacement (s), a first transmitting characteristic 49 to the adjusting displacement (a) is given which runs linearly. In this first region, the throttle lever 12 does not yet lie against the intermediate lever 15. The throttle lever 12 pivots about the pivot axis 16. In order to obtain a pregiven adjusting displacement (a) on the throttle element 7, the throttle lever 12 must be pivoted through a comparatively large actuating displacement (s). In a second range 30, a second transmitting characteristic 50 is given which likewise runs linearly. The second transmitting characteristic 50 has a steeper slope than the first transmitting characteristic 49 so that a nonlinear course of the transmitting characteristic results over the entire adjusting displacement (a). The slope of the curve, which reflects the transmitting characteristic, does not run continuously. In the first region 29, a first slope is given and, in a second region 30, a second steeper slope is given. In the second range 30, the throttle lever 12 lies against the intermediate lever 15 and the two levers pivot about the pivot axis 17. Because of the longer lever arm, only a comparatively slight actuating displacement (s) is needed for a pregiven adjusting movement on the throttle element 7.

Figure 15:
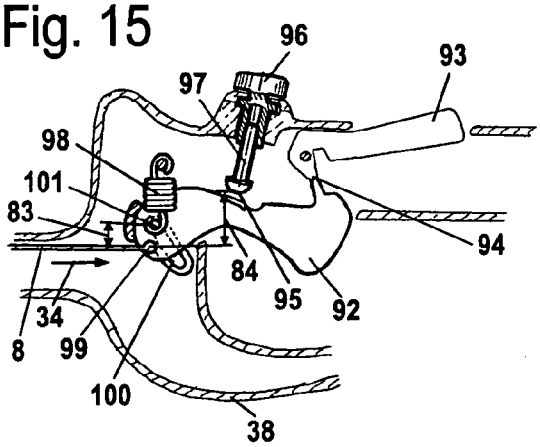
FIG. 15 is a schematic showing another embodiment of a transmitting unit according to the invention.

In FIG. 15, a further embodiment of a transmitting unit is shown which is mounted in a housing 38. The transmitting unit has a throttle lever 92 which is pivotally supported about a first pivot axis 101 in the housing 38. The first pivot axis 101 is formed on a pin which is guided in a slot 100 on the housing 38. A tension spring 98 acts on the pin which presses the pin into the position shown in FIG. 15. The transmitting element 8 is fixed at an attachment point 99 on the throttle lever 92. The pivot axis 101 is at a distance 83 to the attachment point 99 of the transmitting element 8 and this distance 83 is measured perpendicularly to the actuating direction 34.

In the housing 38, a throttle lever lock 93 is journalled which forms a stop 94 for the throttle lever 92 and blocks the throttle lever 92 in the unactuated position. In the housing 38, a set screw 96 is mounted wherein a stop screw 97 is mounted. The stop screw 97 is so supported within the set screw 96 that it cannot rotate about the rotational axis of the set screw 96. If the set screw 96 is rotated, then the stop screw 97 is displaced in its longitudinal direction in the housing 38. A stop 95 is formed on the set screw 96 for the throttle lever 92.

The throttle lever lock 93 is first actuated for actuating the throttle lever 92. Thereafter, the throttle lever 92 can be actuated. The throttle lever 92 pivots about the first pivot axis 101 until the throttle lever 92 comes to lie against the stop 95. With further actuation of the throttle lever 92, a pivoting about the first pivot axis 101 is no longer possible because of the stop 95. The stop 95 forms a second pivot axis which is at a distance 84 to the attachment point 99 and this distance 84 is greater than the distance 83. For further actuation, the throttle lever 92 is pivoted about the stop 95. The pin on which the throttle lever 92 is supported in the housing 38 moves in the slot 100. The actuation of the throttle lever 92 takes place against the force of the tension spring 98.

Figure 16:
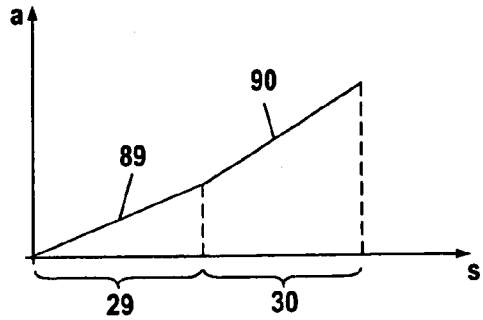
FIG. 16 is a diagram showing a transmitting characteristic.

The transmitting characteristic of the transmitting unit of FIG. 15 is shown in FIG. 16. In a first range 29 of the actuating displacement (s), in which the throttle lever 92 pivots about the first pivot axis 101, there results a first transmitting characteristic 89 having a flat course. In an adjoining second range 30, the throttle lever 92 pivots about the pivot axis defined by the stop 95. In this range, the lever arm for actuating the transmitting element 8 is greater so that a transmitting characteristic 90 having a steeper course results. In the second range, the lever arm is defined by the distance 84.

Figure 17:
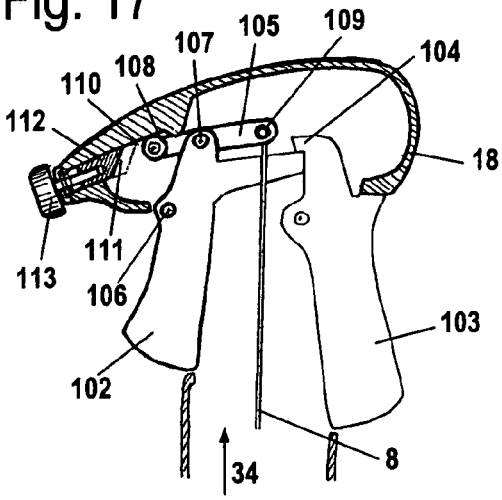
FIGS. 17 to 30 show additional embodiments of transmitting units according to the invention.

In the embodiment of a transmitting unit shown in FIG. 17, a throttle lever 102 is pivotally supported about a pivot axis 106 on a housing 18. An intermediate lever 105 is pivotally supported about a pivot axis 107 on the throttle lever 102. In the housing 18, a throttle lever lock 103 is supported which has a hook 104 and this hook blocks the throttle lever 102 in the unactuated position of the throttle lever lock 103. The pivot axis 107 is arranged on the intermediate lever 105 between an attachment point 109 for the transmitting element 8 and a support roller 108. A cam contour is formed on the housing 18 on which the support roller 108 slides during operation. The cam contour is formed by a first support surface 110 which runs evenly as well as a second cam contour 111 which likewise runs evenly but is at an angle to the first cam contour 110. The cam contour 111 is formed on a wedge 112. The wedge 112 can be displaced by a set screw 113 in the housing 18 so that the position of the cam contour 111 is adjustable.

During operation, the throttle lever lock 103 must first be actuated. Thereafter, the throttle lever 102 can be actuated. The intermediate lever 105 is displaced in its longitudinal direction when the throttle lever 102 is actuated. Because of the contact engagement of the support roller 108 on the first cam contour 110, the longitudinal displacement of the intermediate lever 105 effects a displacement of the support roller 108 on the cam contour 110 which effects an actuation of the transmitting element 8 in the actuating direction 34. Since the first cam contour 110 extends as a flat, a flat course of the transmitting characteristic results. As soon as the support roller 108 lies against the second cam contour 111, there results a steeper course of the transmitting characteristic because the second cam contour 111 pivots the intermediate lever 105 to a greater extent about the pivot axis 107.

Figure 18:
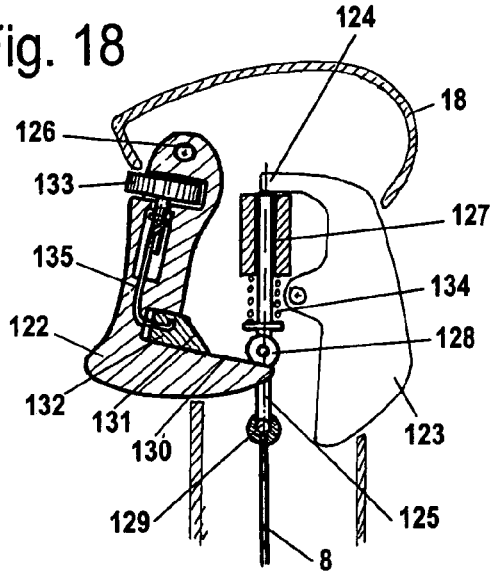

In the embodiment shown in FIG. 18, an intermediate lever 125 is supported on the housing 18 and is displaceable on a guide 127 in its longitudinal direction. The intermediate lever 125 has a support roller 128 which coacts with a cam contour of a throttle lever 122. The throttle lever 122 is pivotally supported about a pivot axis 126 in the housing 18. On the throttle lever 122, a first cam contour 130 as well as a second cam contour 131 are formed with the second cam contour 131 running inclined to the first cam contour 130. The second cam contour 131 is formed on a wedge 132 which can be displaced relative to the throttle lever 122 via a set screw 133. For this purpose, the set screw 133 is connected to the wedge 132 by a band 135, especially, a metal band. The intermediate lever 125 is spring biased in its longitudinal direction relative to the housing 18 by a pressure spring 134.

In addition, a throttle lever lock 123 is mounted on the housing 18 and has a hook 124. The hook 124 blocks the intermediate lever 125. The transmitting element 8 is fixed on an attachment point 129 on the intermediate lever 125. The intermediate lever 125 has a support roller 128 which first slides on the first cam contour 130 when the throttle lever 122 is actuated with a released throttle lever lock 123. The first cam contour 130 effects a displacement of the intermediate lever 125 in FIG. 18 upwardly and therefore an actuation of the transmitting element 8. In the region of the first cam contour 130, a shift of the throttle lever 122 effects only a slight actuation of the throttle element 7. As soon as the support roller 128 lies in contact engagement with the second cam contour 131, the actuating element is actuated with intensity with this second cam contour 131 running considerably steeper. In this range, a slight displacement of the throttle lever 122 is sufficient for a large adjusting displacement of the transmitting element 8.

Figure 19:
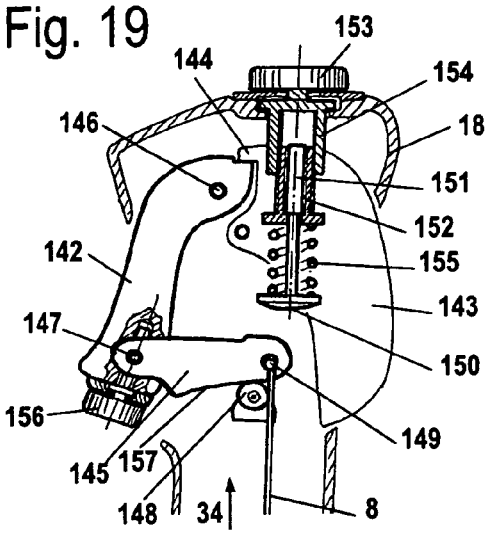

In FIG. 19, an embodiment of a transmitting unit is shown which has a throttle lever 142 and a throttle lever lock 143. The throttle lever lock 143 has a hook 144 which blocks the throttle lever 142. The throttle lever 142 is pivotally supported about a pivot axis 146 in the housing 18. An intermediate lever 145 is pivotally supported about a pivot axis 147 on the throttle lever 142. The position of the pivot axis 147 can be changed via a set screw 156. The transmitting element 8 is fixed at an attachment point 149 on the end of the intermediate lever 145 lying opposite the pivot axis 147. The intermediate lever 145 has a cam contour 157 with which it slides on a support roller 148 when the throttle lever 142 is actuated. The support roller 148 is mounted at a fixed location on the housing 18. Because of the geometry of the cam contour 157, an actuation of the throttle lever 142 first effects only a slight actuation of the throttle element. With a further actuation of the throttle lever 142, the path increases which the actuating point 149 passes through in the actuating direction 34. After a pregiven actuating displacement, the intermediate lever 145 impacts a spring biased stop 150. The stop 150 is resiliently biased by a pressure spring 155 in the direction toward the intermediate lever 145 and is fixed on the housing 18. The stop 150 is mounted on a pin 151 which is held in a guide 152 so as to be displaceable in its longitudinal direction. The guide 152 is threadably engaged in a sleeve 154. The sleeve 154 is fixed to an adjusting wheel 153. When rotating the adjusting wheel 153, the guide 152 screws into the sleeve 154 because the guide 152 is held so as to be non-rotatable relative to the housing 18.

In the transmitting unit shown in FIG. 19 and in view of the above, a nonlinear course of the adjusting displacement results as a function of the actuating displacement as well as a nonlinear course of the actuating force as a function of the actuating displacement. The slope of the curve, which shows the course of the actuating displacement, runs continuously while the slope of the curve, which indicates the course of the actuating force, does not run continuously.

Figure 20:
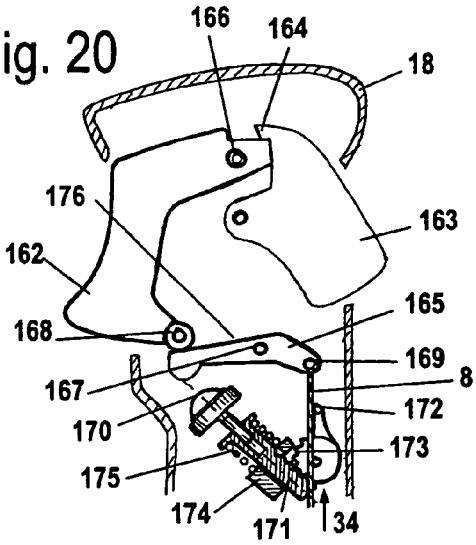

In the embodiment of a transmitting unit shown in FIG. 20, a throttle lever 162 is supported about a pivot axis 166 in a housing 18. The transmitting unit has a throttle lever lock 163 having a hook 164 which blocks the throttle lever 162. The throttle lever 162 has a support roller 168 which acts on an arm of an intermediate lever 165. The intermediate lever 165 is pivotally supported in the housing 18 about a pivot axis 167. The transmitting element 8 is fixedly attached at an attachment point 169 on the arm of the intermediate lever 165 which lies opposite the support roller 168. When pivoting the throttle lever 162, the support roller 168 rolls off on a cam contour 176 on the intermediate lever 165. In the embodiment, the cam contour 176 is configured to be even. However, the cam contour 176 can assume any desirable form in order to achieve another transmitting characteristic.

In the housing 18, a stop 170 is supported which is held on a toothed rack 171. The stop 170 is resiliently biased with a pressure spring 175 opposite a guide 174. The toothed rack 171 meshes with teeth 173 of an adjusting cam 172. The adjusting cam 172 lies against the transmitting element 8.

During operation, the throttle lever lock 163 is first actuated. Thereafter, the throttle lever 162 can be pivoted. The intermediate lever 165 is pivoted about the pivot axis 167 and the transmitting element 8 is actuated. As soon as the intermediate lever 165 lies against the stop 170, a further actuation of the throttle lever 162 effects, in addition to an actuation of the transmitting element 8 on the attachment point 169, also a movement of the toothed rack 171 and therewith a movement of the adjusting cam 172. The adjusting cam 172 deflects the transmitting element 8 transversely to the actuating direction 34 of the transmitting element 8 and effects thereby an additional actuation. In this way, a nonlinear course of the transmitting characteristic of the actuating displacement and the actuating force of the throttle lever results.

Figure 21:
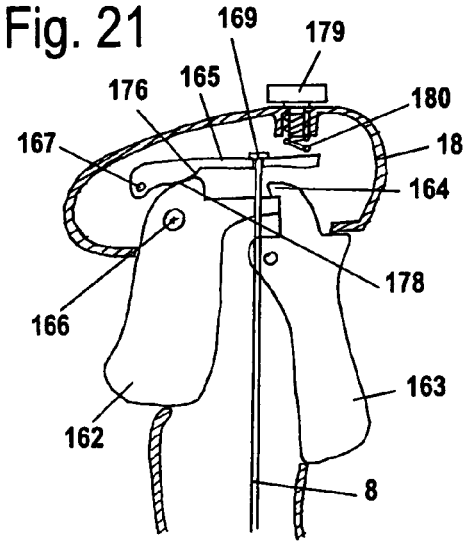

In the embodiment shown in FIG. 21, the throttle lever 162 acts via a cam contour 178 on a cam contour 176 of the intermediate lever 165. The intermediate lever 165 is pivotally supported about a pivot axis 167. The cam contour 176 of the intermediate lever 165 is mounted between the pivot axis 167 and the attachment point 169 of the transmitting element 8 on the lever 165. The arm of the intermediate lever 165 lies facing away from the pivot axis 167. A stop 180 acts on this arm of the intermediate lever 165 starting at a pregiven actuating displacement with this stop being configured as a pressure spring. The pressure spring is guided on the housing 18 on a guide pin 179. The actuating force increases as soon as the intermediate lever 165 lies against the stop 180. A desired nonlinear transmitting characteristic can be adjusted via the configuration of the cam contours 178 and 176.

Figure 22:
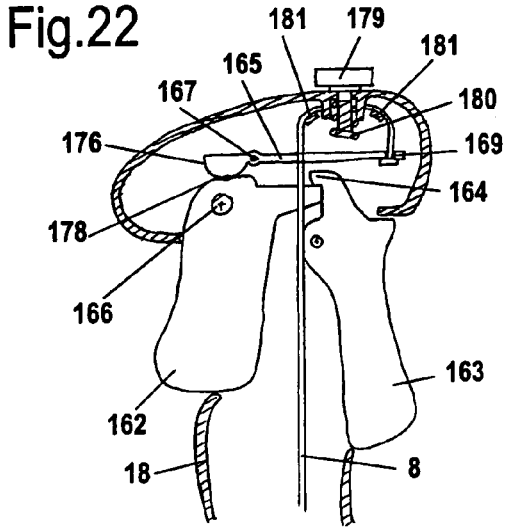

The embodiment of FIG. 22 corresponds essentially to the embodiment of FIG. 21. However, the pivot axis 167 is mounted between the cam contour 176 and the attachment point 169. The stop 180 engages between the attachment point 169 and the pivot axis 167. The transmitting element 8 is redirected on two direction-changing elements 181.

Figure 23:
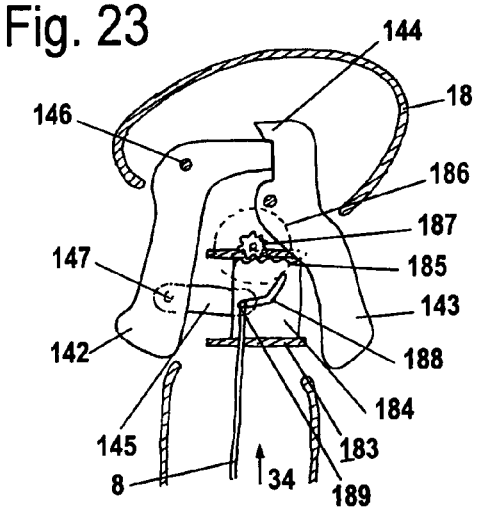

A further embodiment of a transmitting unit is shown in FIG. 23. The configuration of the transmitting unit shown in FIG. 23 is similar to the transmitting unit of FIG. 19. The same reference numerals identify the same components. The transmitting element 8 is mounted on an attachment point 189 on the intermediate lever 145. The attachment point 189 is configured on a pin which is guided in a guide path 188 in a guide piece 184. The guide piece 184 is movably mounted in the housing 18 on a guide 183. To adjust the position of the guide piece 184, an adjusting wheel 186 with teeth 187 is provided which meshes with teeth 185 on the guide piece 184. The guide path 188 has a first section which has a slight slope and a second section having a steep slope. When actuating the throttle lever 142, the pin moves first in the first range on the attachment point 189. The transmitting element 8 is only slightly actuated. As soon as the pin reaches the second region of the guide path 188, the transmitting element 8 is strongly actuated in the same actuation of the throttle lever 142. Other configurations of the guide path 188 can be provided.

Figure 24:
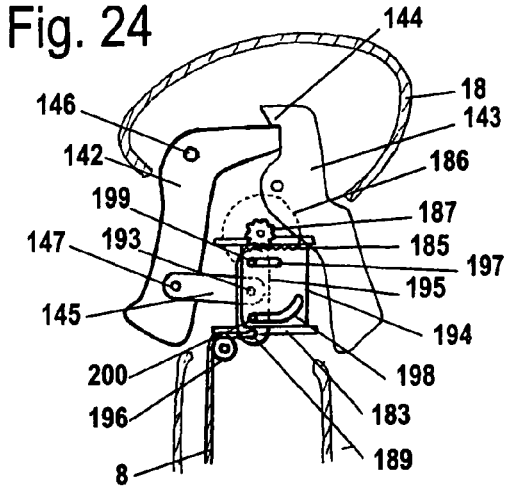

In the embodiment shown in FIG. 24, a second intermediate lever 195 is mounted on the intermediate lever 145. The second intermediate lever 195 is pivotally supported on a pivot axis 193 on the intermediate lever 145. The second intermediate lever 195 is guided with a first guide pin 199 in a first guide path 197 and with a second guide pin 200 in a second guide path 198. The two guide paths 197 and 198 are formed in a guide piece 194. The position of the guide piece 194 in the housing 18 can be shifted via an adjusting wheel 186. The transmitting element 8 is fixed on the second intermediate lever 195 at an attachment point 189 and is guided via a direction-changing roller 196 in the housing. The length of the first guide path 197 parallel to the actuating direction at the attachment point 189 is shorter than the length of the second guide path 198. The second guide path 198 runs in a second section along a circular arc about the end point of the first guide path 197. In this way, an amplified actuation of the transmitting element 8 is achieved. Other configurations of the guide paths 197 and 198 can be provided.

Figure 25:
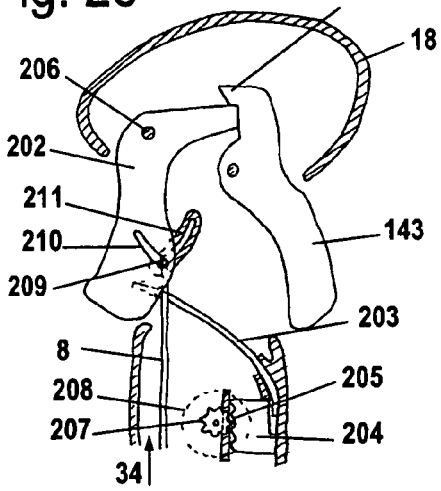

In the embodiment shown in FIG. 25, a throttle lever 202 is pivotally supported about a pivot axis 206 in the housing 18. A throttle lever lock 143 blocks the throttle lever 202 with a hook 144 in the unactuated position. The transmitting element 8 is fixed to an attachment pin 209 on the throttle lever 202. The attachment pin 209 is guided in a guide path 210 in the throttle lever 202 and a second guide path 211 on the housing 18. The two guide paths 210 and 211 lie at an angle to each other so that, with an actuation of the throttle lever 202, a forced guidance of the attachment pin 209 results. The guide paths 210 and 211 run in an arc. In this way, there results a nonlinear course of the transmitting characteristic of the actuating displacement of the throttle lever 202 to the movement of the transmitting element 8. The attachment pin 209 moves with an actuation of the throttle lever 202 in the guide paths 210 and 211. In this way, the transmitting element 8 is actuated in the actuating direction 34. The throttle lever 202 is spring supported via a spring 203. The spring 203 is configured as a leaf spring and is fixed at an adjustment element 204. The adjustment element 204 has teeth 205 which mesh with teeth 207 on an adjusting wheel 208. By rotating the adjusting wheel 208, the position of the adjusting element 204 is shifted and therefore the pretension of the leaf spring 203 is shifted. For this reason, the actuating force can be adjusted via the adjusting wheel 208. With a corresponding configuration of the two guide paths 210 and 211, a desired nonlinear transmitting characteristic of the actuating movement of the throttle lever 202 on the adjusting movement of the adjustment element is realized.

Figure 26:
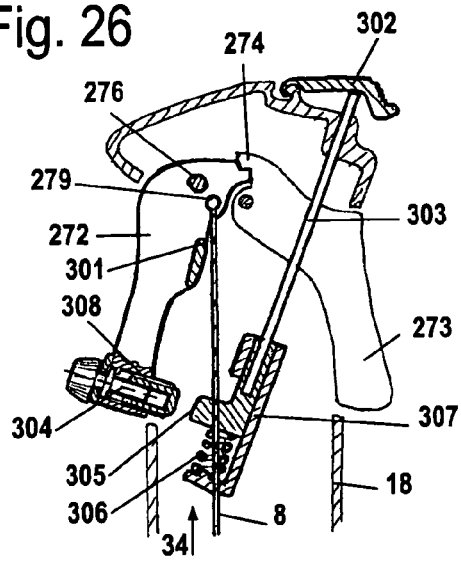

In the embodiment shown in FIG. 26, a throttle lever 272 is supported in a housing 18 on a pivot axis 276. A transmitting element 8 is fixed on an attachment point 271 on the throttle lever 272. A set screw 304 is mounted on the throttle lever 272 and, via this set screw, the position of a sleeve 308 can be adjusted. The sleeve 308 coacts with a stop 305. The stop 305 is fixedly connected to an actuating rod 303 and the actuating rod 303 can be displaced via a lock lever 302. The stop 305 is resiliently biased by a pressure spring 306 in a direction toward the locked position which is shown in FIG. 26. The stop 305 is guided on a guide 307 fixed on the housing.

A throttle lever lock 273 is fixed on the housing 18 and this throttle lever lock blocks the throttle lever 272 with a hook 274. The throttle lever lock 273 is first actuated to actuate the throttle lever 272. Thereafter, the throttle lever 272 can be actuated until the sleeve 308 lies against the stop 305. For further actuation, the lock lever 302 must first be actuated against the force of the spring 306 so that the stop 305 moves outside of the region of the sleeve 308 and a further actuation of the throttle lever 272 is possible.

On the throttle lever 272, a deflection cam 301 is mounted which comes into engagement with the transmitting element 8 with a further actuation of the throttle lever 272 and the transmitting element 8 is deflected in a direction perpendicular to the actuation direction 34. In this way, an actuation of the transmitting element 8 takes place. As soon as the deflection cam 301 comes into engagement with the transmitting element 8, a stronger actuation of the throttle element 7 results thereby. In this way, a nonlinear transmitting characteristic is achieved.

FIGS. 27 to 31 show embodiments of actuating units wherein two actuating elements are provided for a transmitting element 8.

Figure 27:
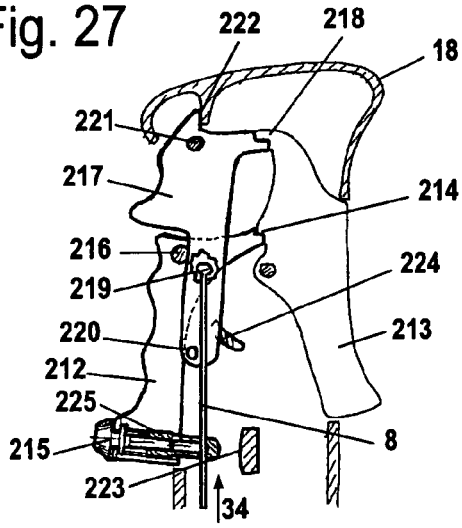

In the embodiment shown in FIG. 27, a first throttle lever 212 is pivotally supported on the housing 18 about a pivot axis 216. The first throttle lever 212 has a set screw 215 via which a sleeve 225 can be displaced. The sleeve 225 coacts with a stop 223 fixed on the housing. In this way, the adjusting displacement of the first throttle lever 212 is limited. The transmitting unit further includes a second throttle lever 217 which can be actuated in the conventional manner by the index finger of the operator. The second throttle lever 217 is pivotally supported about a pivot axis 221 in the housing 18 and lies, in the unactuated position, against a stop 222 on the housing 18. The transmitting element 8 is fixed to an attachment point 219 on the second throttle lever 217. The second throttle lever 217 has an entraining element 220 which lies against the first throttle lever 212. Next to the transmitting element 8 and in the unactuated position (FIG. 27) of the throttle levers 212 and 217, a deflecting cam 224 is mounted at a distance to the transmitting element 8 on the housing 18. The transmitting unit includes a throttle lever lock 213, a first hook 214 for the first throttle lever 212 and a second hook 218 for the second throttle lever 217.

To actuate the throttle levers 212 and 217, the throttle lever lock 213 must first be actuated so that the hooks 214 and 218 release the throttle levers 212 and 217. The first throttle lever 212 is actuated for a fine adjustment of the adjusting displacement. The first throttle lever 212 acts via the entraining element 220 on the second throttle lever 217 and pivots the second throttle lever 217 about the pivot axis 221. In this way, the transmitting element 8 is actuated slightly. If the transmitting element 8 is to be actuated strongly, then the second throttle lever 217 is actuated. This effects a comparatively large pivot displacement and therewith a strong actuation of the transmitting element 8. As soon as the transmitting element 8 lies against the deflecting cam 224, an additional deflection of the transmitting element 8 in a direction perpendicular to the actuating direction 34 is achieved which effects an additional actuation of the throttle element 7. In this way, a nonlinear transmitting characteristic is achieved.

Figure 28:
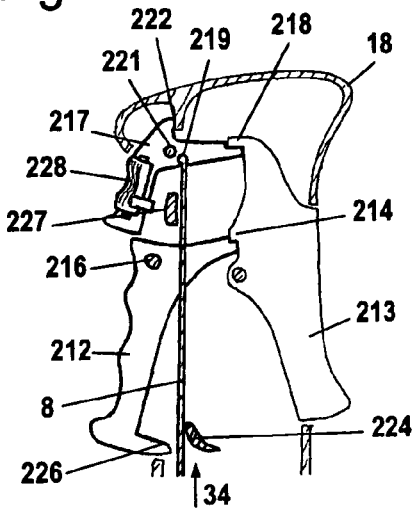

In the embodiment shown in FIG. 28, a first throttle lever 212 and a second throttle lever 217 are likewise provided. The first throttle lever 212 has an actuator 226 which deflects the transmitting element 8 in a direction perpendicular to the actuating direction 34 and presses the transmitting element 8 against a housing-fixed deflection cam 224. In this way, only a slight actuation of the transmitting element 8 is achieved when actuating the first throttle lever 212. With actuation, the second throttle lever 217 pivots about a pivot axis 221 and, in this way, actuates the transmitting element 8 fixed on the attachment point 219. On the second throttle lever 217, a slider 228 is provided which coacts with a stop 227 on the housing 18. The slider 228 fixes the end position of the second throttle lever 217. The slider 228 in this way makes possible a displacement of the end position of the second throttle lever 217.

Figure 29:
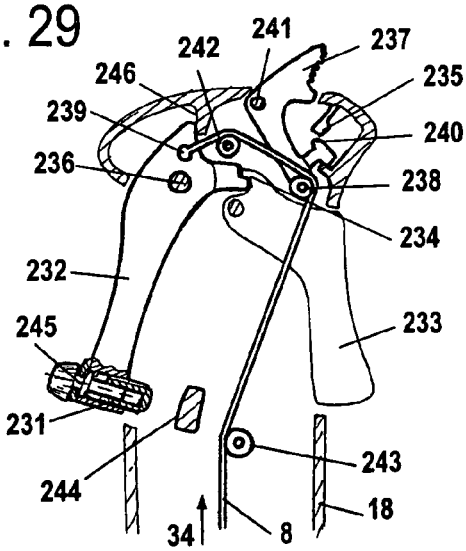

The transmitting unit shown in FIG. 29 has a first throttle lever 232 which is pivotally supported about a pivot axis 236 on the housing 18. A sleeve 231 is mounted on the first throttle lever 232 and this sleeve coacts with a stop 244 fixed on the housing. The position of the sleeve 231 can be changed via a set screw 245. The transmitting element 8 is fixed on the first throttle lever 232 at an attachment point 239. In the unactuated position, the throttle lever 232 lies against a stop 246 fixed on the housing. In the housing, the transmitting element 8 is guided via: a first direction-changing roller 242 fixedly mounted on the housing; a second direction-changing roller 238 mounted on a second throttle lever 237; and, a third direction-changing roller 243 fixedly mounted to the housing.

The transmitting unit includes a throttle lever lock 233 having a hook 234 which blocks the throttle lever 232 in the unactuated position of the throttle lever lock 233. With a slight actuation of the transmitting element 8, the first throttle lever 232 is actuated after releasing the throttle lever lock 233. In order to provide a large adjusting displacement, the second throttle lever 237 is provided which is pivotally supported about a pivot axis 241 in the housing 18. The second throttle lever 237 deflects the transmitting element 8 transversely to the longitudinal direction of the transmitting element 8 via a movement of the direction-changing roller 238 and thereby effects a large adjusting movement at the adjusting element. The second throttle lever 237 has a latch projection 240 which coacts with a latch hook 235 fixed to the housing so that the second throttle lever 237 can be blocked in the completely actuated position.

Figure 30:
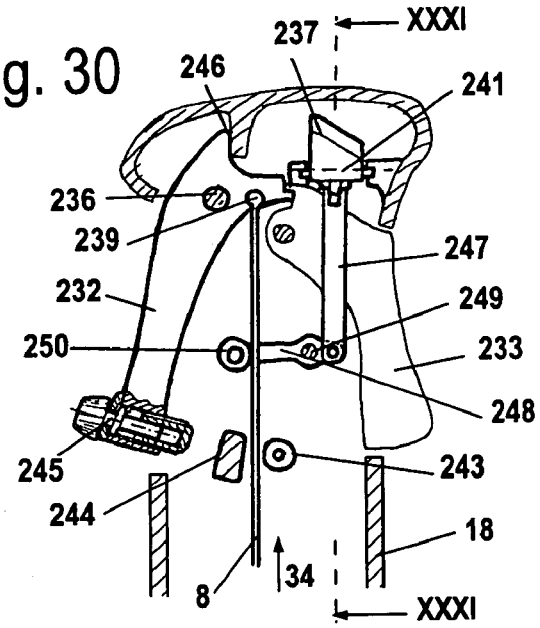
Figure 31:
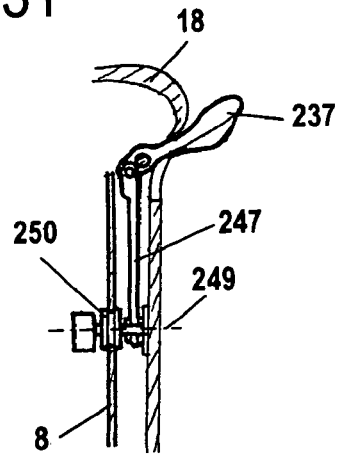
FIG. 31 is a section view taken along line XXXI-XXXI of FIG. 30.

The embodiment shown in FIGS. 30 and 31 corresponds functionally essentially to the embodiment of FIG. 29. In the embodiment of FIGS. 30 and 31, the second throttle lever 237 is pivotally supported about a pivot axis 241 which is perpendicular to the pivot axis 236 of the throttle lever 232. As shown in FIG. 31, the second throttle lever 237 acts via an intermediate lever 247 on a deflecting lever 248. The intermediate lever 247 pivots the deflecting lever 248 about a pivot axis 249 which is parallel to the pivot axis 236 of the first throttle lever 232. A deflecting roller 250 is mounted on the deflecting lever 248 and this deflecting roller acts on the transmitting element 8 transversely to the actuating direction 34. The transmitting element 8 is pressed against a direction-changing roller 243 fixed on the housing. The actuation of the throttle lever 232 thereby provides another transmitting characteristic than the actuation of the second throttle lever 237 so that, overall, a nonlinear transmitting characteristic results.

Figure 32:
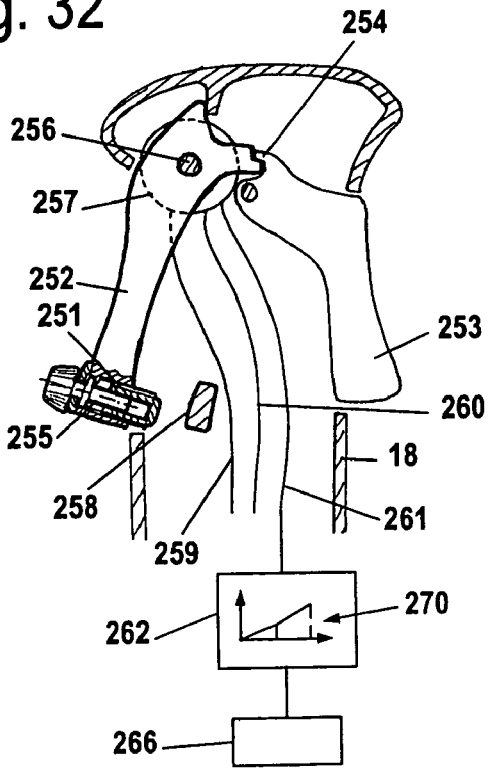
FIGS. 32 to 36 show additional embodiments of transmitting units according to the invention.
Figure 33:
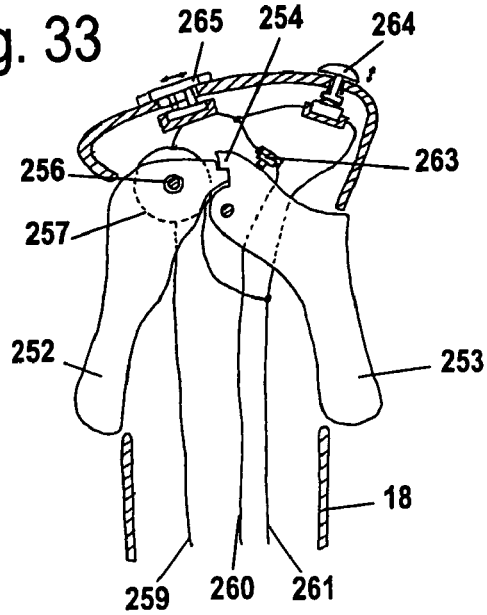

Embodiments of transmitting units are shown in FIGS. 32 and 33 wherein the transmission of the adjusting movement of a throttle lever 252 on a throttle element 7 takes place electrically. For this purpose, both transmitting units include electrical adjusting devices 257. An electrical adjusting device can, for example, be a potentiometer or the like having a voltage divider circuit. A throttle lever lock 253 is provided in each embodiment which blocks the throttle lever 252 with a hook 254 in an unactuated position of the throttle lever lock 253.

In the embodiment of FIG. 32, a sleeve 251 is mounted on the throttle lever 252 which sleeve coacts with a stop 258 fixed to the housing and the position of the sleeve can be changed via a set screw 255. The sleeve 251 delimits the maximum actuating displacement of the throttle lever 252. The throttle lever 252 is pivotally supported about a pivot axis 256 in whose region the electric adjusting device 257 is mounted. The electric adjusting device 257 is grounded with a ground line 259. A positive line 260 is provided which supplies an input voltage. A control line 261 supplies a control signal which corresponds to the position of the throttle lever 252. This control signal is supplied to a control 262 and is converted into an output signal based on a pregiven transfer characteristic 270 and, based on this output signal, an actuator 266 for the throttle element 7 is actuated. The actuator 266 can, for example, be a positioning motor.

In the embodiment of FIG. 33, the control line 261 is connected to a control and an actuator. The positive line 260 is connected to the adjusting device 257 via a switch 263 and a control slider 265. The switch 263 is configured as an interrupt switch and is activated when actuating the throttle lever lock 253 so that only with an actuated throttle lever lock 253, a current can flow to the electric adjusting device 257. The control slider 265 permits an adjustment of the voltage supplied to the electric adjusting device 257. An interrupt switch 264 is arranged in the control line 261 and when the switch 264 is actuated, no signal is conducted any longer via the control line 261 to the control 262.

Additional control elements or switching elements can be provided for an electric transmission.

Figure 34:
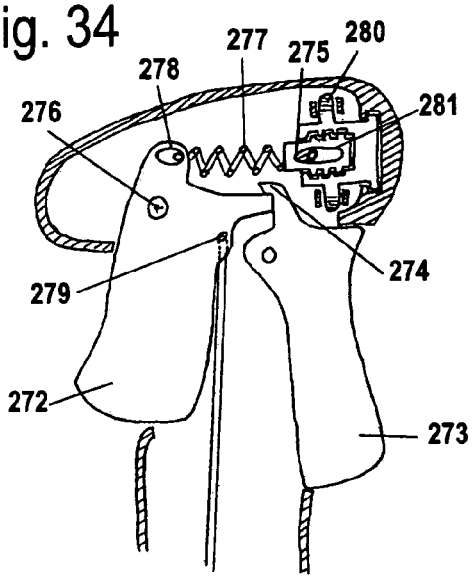

In the embodiments of FIGS. 34 to 37, the actuating force referred to the actuating displacement is not constant. The transmitting unit shown in FIG. 34 is similar to the functional configuration of the transmitting unit of FIG. 26. In the transmitting unit shown in FIG. 34, an elongated slot opening 278 is provided on the throttle lever 272 wherein an end of a tension spring 277 is mounted. The second end of the tension spring 277 is mounted in an elongated slot 281 provided fixedly in the housing. The position of the housing-fixed elongated slot 281 can be adjusted via an adjusting wheel 280. A stop 275 is formed on the elongated slot 281. As soon as the throttle lever 272 has gone through a pregiven actuating displacement, the spring 277 lies on the stop 275. With a further actuation, the force of the spring 277 must be overcome. In this way, a slight actuating force first results which increases greatly as soon as the spring 277 comes into engagement.

Figure 35:
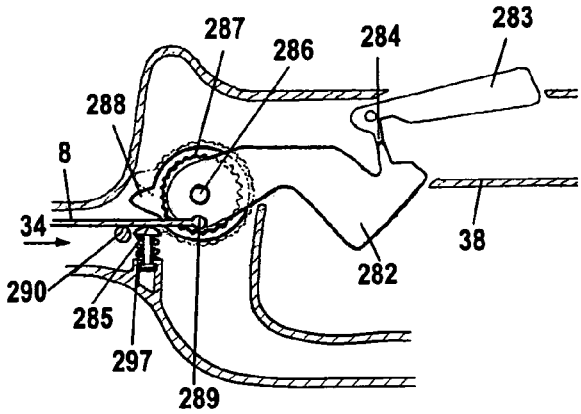

In the embodiment shown in FIG. 35, a throttle lever 282 is pivotally supported about a pivot axis 286 in a housing 38. The transmitting element 8 is fixed at an attachment point 289 on the throttle lever 282. A deflecting cam 288 is mounted on the throttle lever 282 via a set of teeth 287. The transmitting unit has a throttle lever lock 283 which forms a stop 284 for the throttle lever 282. On the housing 38, in the region of the deflecting cam 288, a stop 285 is provided which is resiliently biased via a spring 297 relative to the housing. The transmitting element 8 lies on the longitudinal side, which lies opposite the deflecting cam 288, on a direction-changing pin 290. After actuation of the throttle lever lock 283, the throttle lever 282 can be actuated and is pivoted about the pivot axis 286. The deflecting cam 288 is pivoted via the teeth 287. As soon as the deflecting cam 288 comes into engagement with the stop 285, the force of the spring 297 must be overcome for further actuation of the throttle lever 282 so that the actuating force increases. At the same time, the deflecting cam 288 actuates the transmitting element 8 in a direction perpendicular to the actuating direction 34 and effects an additional actuation of the transmitting element 8. In this way, an increasing actuating force as well as an increasing adjusting displacement at the throttle element 7 is achieved.

Figure 36:
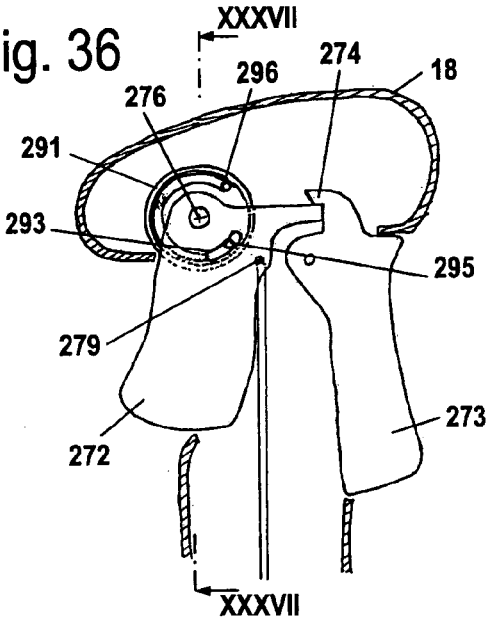
Figure 37:
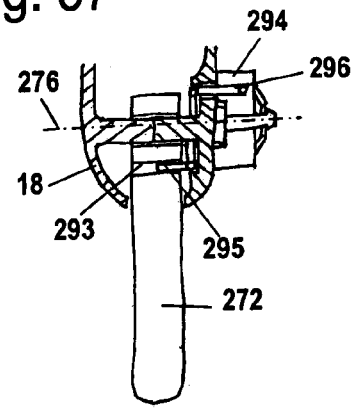
FIG. 37 is a schematic section view taken along line XXXVII-XXXVII of FIG. 36.

A torsion spring 291 is mounted on the housing 18 in the embodiment shown in FIG. 36. A first end 295 of the torsion spring 291 is mounted in a guide slot 293 in the throttle lever 272. This is also shown in FIG. 37. A second end 296 of the torsion spring 291 lies on a stop 294 (FIG. 37) which is configured so as to be fixed to the housing. The stop 294 can also be displaceably configured relative to the housing 18. When actuating the throttle lever 272, the first end 295 of the torsion spring 291 first slides in the guide slot 293, until it comes into engagement with a stop 300 formed at the end of the guide slot 293. For further actuation of the throttle lever 272, the force of the torsion spring 291 must be overcome. In this way, the actuating force increases greatly.

Figure 38:
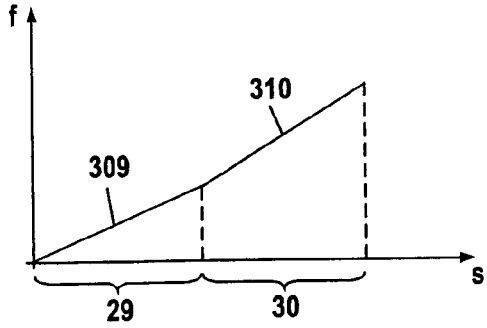
FIG. 38 is a diagram showing a transmitting characteristic.

The course of the actuating force (f) as a function of the actuating displacement (s) is shown in FIG. 38. In a first range 29, wherein the spring is not yet actuated, there results a first transmitting characteristic 309. In a second range 30, the force of the spring must be overcome so that a steeper slope of the characteristic line results. A second transmitting characteristic 310 results.

FIGS. 39 to 43 show an improvement of the embodiment of FIG. 4. The same reference numerals identify corresponding components. In FIGS. 39 to 43, the position of the slider 46 is shown schematically in plan view above the section view of the handle 31.

Figure 39:
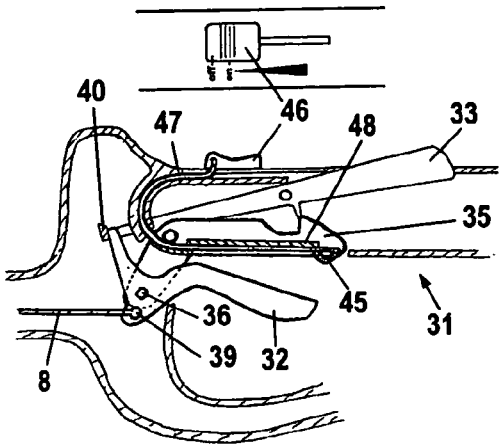
FIGS. 39 to 43 show an improvement of the embodiment of FIG. 4 in different positions of the transmitting unit and the switch element.
Figure 40:
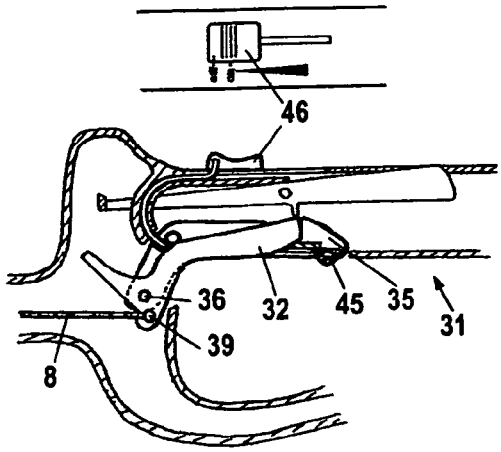

In the embodiment of FIGS. 39 to 43, the slider 46 has the positions which are assigned to different positions of the stop 45 wherein the throttle lever 32 can impact against stop 45. In addition, the slider 46 has an inactive position shown in FIGS. 39 and 40. In FIG. 39, the throttle lever 32 is unactuated. The slider 46 is disposed in a position wherein the stop 45 is inactive. When actuating the throttle lever lock 33 and the throttle lever 32, the throttle lever 32 pivots about its pivot axis 36 into the completely actuated position shown in FIG. 40. The throttle lever 32 pivots past stop 45. The intermediate lever 35 is not actuated. The actuation of the transmitting element 8 takes place in accordance with an essentially linear transmission characteristic.

Figure 41:
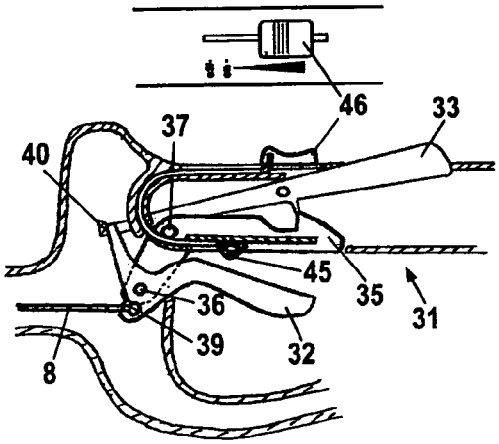
Figure 42:
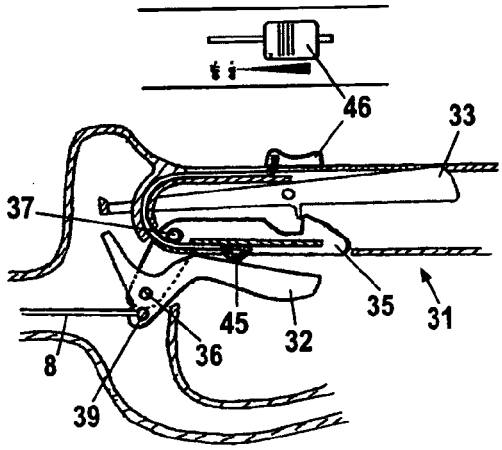
Figure 43:
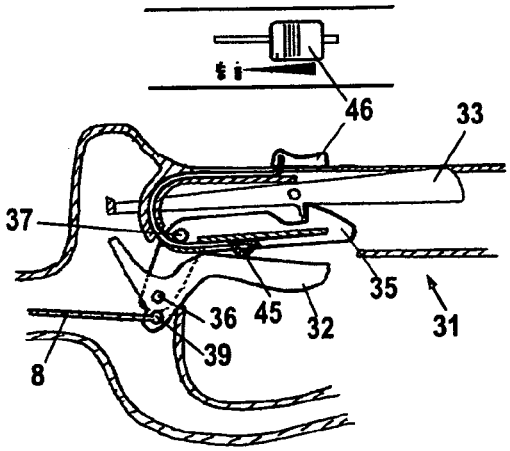

In FIGS. 41 to 43, the slider 46 is shown in a position whereat the stop 45 is active. FIG. 41 shows the throttle lever 32 in the unactuated position. The slider 46 is disposed in a center position wherein the stop 45 comes into engagement with the throttle lever 32. If the throttle lever 32 and the throttle lever lock 33 are actuated, then the throttle lever 32 first pivots about the pivot axis 36 until the stop 45 lies against the throttle lever 32. If the throttle lever 32 is actuated further out of the half-throttle position shown in FIG. 42, then the throttle lever 32 comes to lie against stop 45 and pivots together with the intermediate lever 35 about the pivot axis 37 of the intermediate lever 35 into the full load position shown in FIG. 43. In this position of the slider 46, a nonlinear transmission characteristic of the actuating displacement results. With the slider 46, the intermediate lever 35 with the stop 45, which effects the nonlinearity of the transmission characteristic, can be shifted into an inactive state. In addition, the nonlinearity can be adjusted via the position of the stop 45 with the slider 46.

In the further embodiments shown, a switch element can also be provided with which the unit, which effects the nonlinearity of the transmitting characteristic, can be switched into an inactive state. A switch element of this kind can especially be provided also with an electric transmission.

It is understood that the foregoing description is that of the preferred embodiments of the invention and that various changes and modifications may be made thereto without departing from the spirit and scope of the invention as defined in the appended claims.

What is claimed is:

1. A portable handheld work apparatus comprising:

a drive motor;

an adjusting element operatively connected to said drive motor for controlling said drive motor;

a movable actuating device displaceable through an actuating displacement (s);

a transmitting unit for transmitting a movement of said actuating device to said adjusting element; and, said transmitting unit defining a transmitting characteristic which is a nonlinear function of said actuating displacement (s).

2. The work apparatus of claim 1, wherein said actuating displacement (s) has a first range and a second range; and, said transmitting characteristic is a composite transmitting characteristic comprising a first transmitting characteristic corresponding to said first range and a second transmitting characteristic corresponding to said second range.

3. The work apparatus of claim 2, wherein said transmitting unit comprises an adjustable stop which is actuated after said actuating device moves through said first range.

4. The work apparatus of claim 2, further comprising an adjustable blocking device movable between a first position whereat said blocking device blocks a further actuation of said actuating device beyond said first range after completing a movement through said first range and a second position whereat said blocking device permits a further actuation of said actuating device beyond said first range.

5. The work apparatus of claim 2, wherein said movable actuating device is actuated with an application of an actuating force (f) and said transmitting characteristic is said actuating force (f) and said transmitting unit includes a spring which counters the movement of said actuating device in one of said ranges.

6. The work apparatus of claim 2, wherein said transmitting unit comprises a transmitting element and said nonlinear transmitting characteristic is the displacement of said adjusting element.

7. The work apparatus of claim 6, wherein said actuating device includes an actuating element and an intermediate lever operatively connected to said actuating element so as to permit said actuating element to operate on said transmitting element via said intermediate lever.

8. The work apparatus of claim 7, wherein said transmitting element is attached to said intermediate lever at an attachment point.

9. The work apparatus of claim 7, further comprising a housing and said transmitting element being attached at an attachment point; said actuating element being pivotally supported on said intermediate lever about a first pivot axis; said intermediate lever being pivotally supported on said housing about a second pivot axis; said transmitting element defining a direction of displacement; and, said second pivot axis being at a distance to said attachment point measured perpendicularly to said direction of displacement which is different than said first pivot axis.

10. The work apparatus of claim 9, wherein said actuating element pivots about said first pivot axis in said first range of said actuating displacement (s); and, said actuating element and said intermediate lever conjointly pivot about said second pivot axis in said second range of said actuating displacement (s).

11. The work apparatus of claim 7, further comprising a housing and wherein said actuating element is pivotally mounted on said housing about a first pivot axis and said intermediate lever is pivotally mounted on said actuating element about a second pivot axis.

12. The work apparatus of claim 11, wherein said intermediate lever is moved along a cam contour relative to said housing.

13. The work apparatus of claim 7, further comprising a housing and wherein said actuating element is pivotally movable in said housing about a first pivot axis; and, said intermediate lever is displaceably guided in said housing.

14. The work apparatus of claim 13, wherein said intermediate lever is actuated by said actuating element via a cam contour.

15. The work apparatus of claim 14, further comprising setting means for adjusting the position of said cam contour.

16. The work apparatus of claim 7, further comprising a housing; said actuating element being pivotally supported on said housing about a first pivot axis; said intermediate lever being pivotally supported on said housing about a second pivot axis; said intermediate lever having a cam contour; and, said actuating element acting on said cam contour when pivoting about said first pivot axis so as to cause said intermediate lever to pivot about said second pivot axis.

17. The work apparatus of claim 6, wherein said actuating device comprises an actuating element; and, said transmitting element is attached to said actuating element at an attachment point.

18. The work apparatus of claim 17, wherein said actuating element is pivotally supported about a first pivot axis and is pivotally supported about a second pivot axis; and, said actuating element pivots about said first pivot axis in said first range and pivots about said second pivot axis in said second range.

19. The work apparatus of claim 17, wherein said transmitting element is held by an attachment pin on said actuating element; and, said attachment pin is mounted on said actuating element so as to cause the position of said attachment pin on said actuating element to change in dependence upon said actuating displacement (s) of said actuating element.

20. The work apparatus of claim 17, wherein said transmitting unit includes a deflecting cam which is at a first distance to said transmitting element in said first range of said actuating displacement (s) and which acts on said transmitting element in said second range of said actuating displacement (s) between said attachment point and said adjusting element to deflect said transmitting element.

21. The work apparatus of claim 1, wherein said actuating displacement (s) includes a first range and a second range; and, said actuating device comprises a first actuating element provided for an actuation in said first range of said actuating displacement (s) and a second actuating element provided for actuation in said second range of said actuating displacement (s).

22. The work apparatus of claim 21, wherein said transmitting unit comprises a transmitting element connected to an attachment point on said first actuating element; and, said second actuating element acts on said transmitting element between said attachment point and said adjusting element.

23. The work apparatus of claim 21, wherein said transmitting unit comprises a transmitting element connected to said first actuating element; and, said second actuating element acts on said first actuating element.

24. The work apparatus of claim 1, wherein said actuating device comprises an actuating element displaceable through said actuating displacement (s); an electric positioning unit operatively connected to said actuating element and being for generating an electric signal in correspondence to said actuating displacement (s); said transmitting unit comprises a control circuit connected to said electric positioning unit for receiving said electric signal as an input signal; and, said control circuit is configured to generate an output signal for determining the position of said adjusting element in dependence upon a desired transfer characteristic.

25. The work apparatus of claim 1, further comprising a switch element for switching said transmitting unit into an inactive state.

* * * * *